US011446731B2

(12) United States Patent
Cornish

(10) Patent No.: US 11,446,731 B2
(45) Date of Patent: Sep. 20, 2022

(54) DIE APPARATUS FOR FORGING STEERING RACKS

(71) Applicant: BISHOP STEERING TECHNOLOGY PTY LTD, Rosehill (AU)

(72) Inventor: Wayne Bruce Cornish, Norah Head (AU)

(73) Assignee: BISHOP STEERING TECHNOLOGY PTY LTD, Rosehill (AU)

( * ) Notice: Subject to any disclaimer, the term of this patent is extended or adjusted under 35 U.S.C. 154(b) by 234 days.

(21) Appl. No.: 16/336,412

(22) PCT Filed: Nov. 5, 2017

(86) PCT No.: PCT/AU2017/051217
§ 371 (c)(1),
(2) Date: Mar. 25, 2019

(87) PCT Pub. No.: WO2018/094451
PCT Pub. Date: May 31, 2018

(65) Prior Publication Data

US 2019/0232360 A1 Aug. 1, 2019

(30) Foreign Application Priority Data

Nov. 27, 2016 (AU) ..... 2016904870

(51) Int. Cl.
*B21J 13/10* (2006.01)
*B21K 27/04* (2006.01)
*B21K 1/76* (2006.01)

(52) U.S. Cl.
CPC ..... *B21J 13/10* (2013.01); *B21K 1/767* (2013.01); *B21K 27/04* (2013.01)

(58) Field of Classification Search
CPC ..... B21J 13/10; B21K 27/00; B21K 27/01; B21K 27/02; B21K 27/03; B21K 27/04;
(Continued)

(56) References Cited

U.S. PATENT DOCUMENTS 2,275,561 A * 3/1942 Sahlin ..... B21D 43/10 72/427
4,571,982 A 2/1986 Bishop et al.
(Continued)

FOREIGN PATENT DOCUMENTS

AU 2002238299 B2 10/2002
DE 2929800 A1 * 12/1981 ..... B21D 43/05
(Continued)

OTHER PUBLICATIONS

International Search Report (PCT/ISA/210) issued in PCT/AU2017/051217, dated Mar. 2, 2018.
(Continued)

*Primary Examiner* — Jessica Cahill
*Assistant Examiner* — Jared O Brown
(74) *Attorney, Agent, or Firm* — Birch, Stewart, Kolasch & Birch, LLP

(57) ABSTRACT

A support apparatus for supporting a steering rack forged in a forging die, comprising a gripper to grip the shank of the rack, a lost-motion mechanism supporting the gripper and permitting limited movement in the direction of closing of the forging die, and a side-shift mechanism to move the gripper sideways. The lost-motion mechanism abuts the die assembly as the forging die closes thereby positioning the gripper to grip the shank of the steering rack during the final closing travel of the forging die. The gripper then lifts the steering rack as the forging die opens. The side-shift mechanism then moves the gripped steering rack sideways.

9 Claims, 8 Drawing Sheets

(58) Field of Classification Search
CPC .. B21K 1/767; B21K 1/768; B25J 5/02; B25J 5/12; B25J 13/02
USPC ..... 72/361
See application file for complete search history.

(56) References Cited

U.S. PATENT DOCUMENTS

| | | | | |
|---|---|---|---|---|
| 5,862,701 | A | 1/1999 | Bishop et al. | |
| 2002/0044439 | A1* | 4/2002 | Seiji | |
| 2004/0182125 | A1* | 9/2004 | McLean | B21K 1/767 72/361 |
| 2006/0016238 | A1* | 1/2006 | Seiji | |
| 2007/0079643 | A1* | 4/2007 | Dohmann | |
| 2008/0229803 | A1* | 9/2008 | Yamawaki | B21K 1/767 72/356 |
| 2011/0138946 | A1* | 6/2011 | Yamakawa | |
| 2013/0042662 | A1* | 2/2013 | Cornish | |

FOREIGN PATENT DOCUMENTS

| | | | |
|---|---|---|---|
| GB | 832611 | A | 4/1960 |
| WO | WO 2005/053875 | A1 | 6/2005 |
| WO | WO 2011/140580 | A1 | 11/2011 |

OTHER PUBLICATIONS

Written Opinion (PCT/ISA/237) issued in PCT/AU2017/051217, dated Mar. 2, 2018.

* cited by examiner

DIE APPARATUS FOR FORGING STEERING RACKS

TECHNICAL FIELD

The present invention relates to the manufacture of steering racks for vehicle rack and pinion steering gears, and in particular to die apparatus for forging steering racks.

BACKGROUND

It is known to forge the toothed region of a vehicle steering rack. Die apparatus for warm forging steering racks are disclosed in U.S. Pat. No. 4,571,982 (Bishop et al), U.S. Pat. No. 5,862,701 (Bishop et al), WO 2005/053875 A1 (Bishop Innovation), and WO 2011/140580 A1 (Bishop Steering Technology Pty Ltd).

Warm forging of steel is well known. The actual temperature used for warm forging depends on the application, and can range from 600° C. to 1000° C. Temperatures in the range 650° C. to 800° C. are particularly well suited to forging precision net shape gear teeth that do not require finish machining, such as steering racks.

A problem with warm forging steering racks is the time required to remove the forged rack, service the die, and load another bar into the die apparatus. This is a problem for several reasons. Firstly, if the forged rack is left in the die for too long it transfers excessive heat to the die elements, which may damage them prematurely. Secondly, the time to unload, service and load slows down the operation of the die. Servicing the die typically involves spraying the die elements with lubricant between each forging cycle, and the forged rack must be clear of the die elements for this to be performed. It may also involve cleaning the die. The unload, load and servicing times are typically the limiting factors in reducing the overall forging cycle time. A complete forging cell for steering racks is very expensive and any reduction to the cycle time improves the economic viability of forging steering racks.

It is an object of the present invention to provide an improved die apparatus for forging steering racks, or at least a useful alternative.

SUMMARY OF INVENTION

The present invention consists of a support apparatus for supporting a steering rack forged in a forging die, the forging die comprising a first die assembly and a second die assembly movable towards each other to forge the steering rack from a bar. The support apparatus being adapted to be attached to the second die assembly.

The support apparatus comprising a gripper adapted to grip the shank of the forged steering rack, a lost-motion mechanism supporting the gripper and permitting limited relative movement between the gripper and the second die assembly in the direction of closing of the forging die, and a side-shift mechanism adapted to move the gripper sideways.

The lost-motion mechanism being adapted to abut the first die assembly as the forging die closes to forge the steering rack from a bar placed in the forging die thereby positioning the gripper to grip the shank of the steering rack during the final closing travel of the forging die, the gripper being operable to grip the shank of the steering rack whilst the lost-motion mechanism abuts the first die assembly, the gripper being adapted to lift the gripped steering rack away from the first die assembly as the forging die opens, the side-shift mechanism being adapted to move the gripped steering rack sideways. The apparatus preferably being adapted to enable another bar to be placed in the forging die whilst the steering rack is held by the gripper and/or the forging die to be serviced whilst the steering rack is held by the gripper.

Preferably the lost-motion mechanism is biased towards the first die assembly. Preferably the lost-motion mechanism is biased by springs. Preferably the lost-motion mechanism is guided by rods, each rod having a head to limit the motion of the lost-motion mechanism.

Preferably the second die assembly comprises a tooth die.

Preferably the side-shift mechanism is moved by means of an actuator. In one preferred embodiment, the side-shift mechanism comprises a bearing rail and at least one bearing, the bearing being slidable along the bearing rail to guide the motion of the side-shift mechanism, the actuator comprising an internal bore in the bearing rail and a piston movable in the bore. Preferably, the bearing rail is formed from a solid length (e.g., single piece) of bearing rail and the bore is machined in the solid length of bearing rail.

BEST MODE OF CARRYING OUT THE INVENTION

Figure 1:
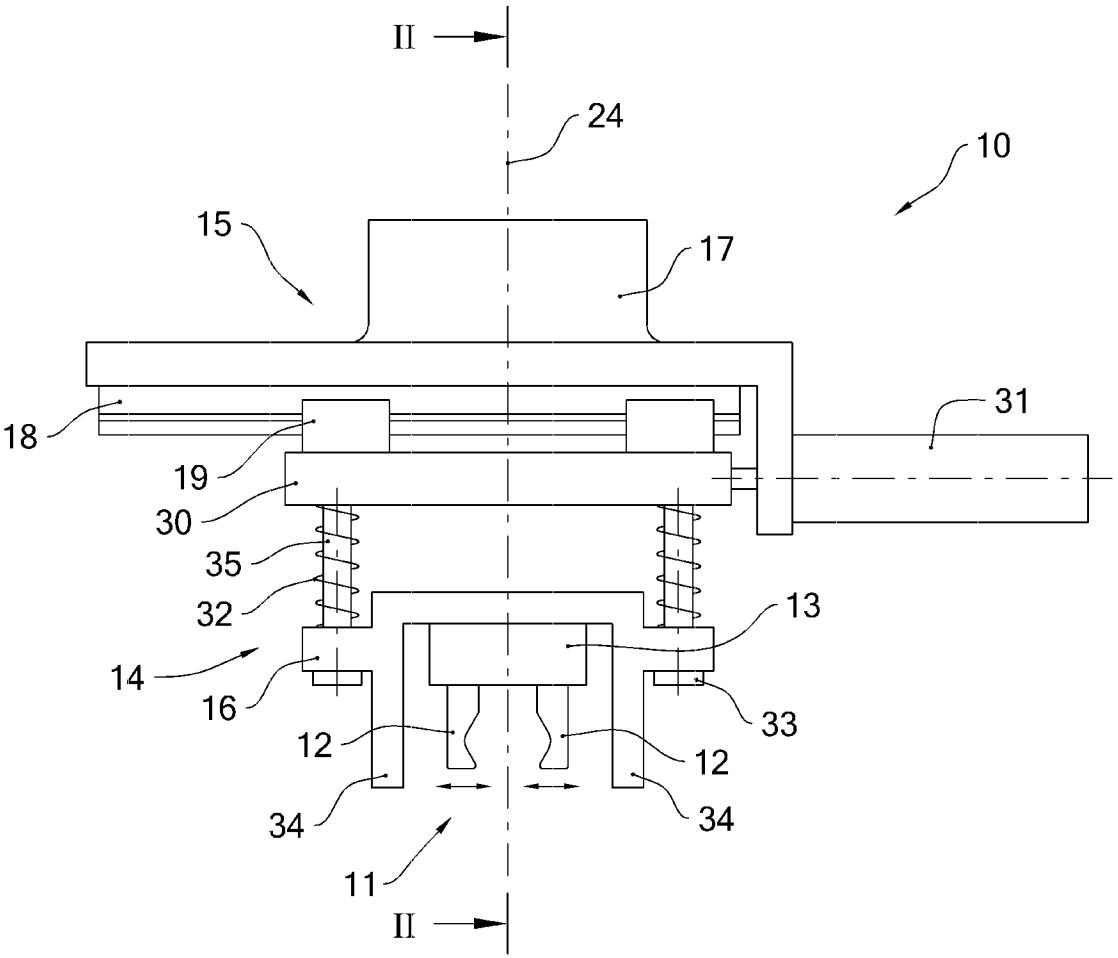
FIG. 1 is a front view of a first embodiment of an apparatus in accordance with the present invention for supporting a forged steering rack after the rack has been forged in a forging die.
Figure 2:
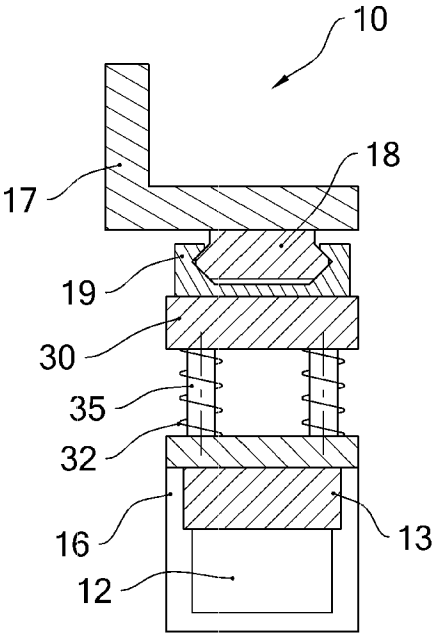
FIG. 2 is a sectional view along II-II of the apparatus shown in FIG. 1.
Figure 3:
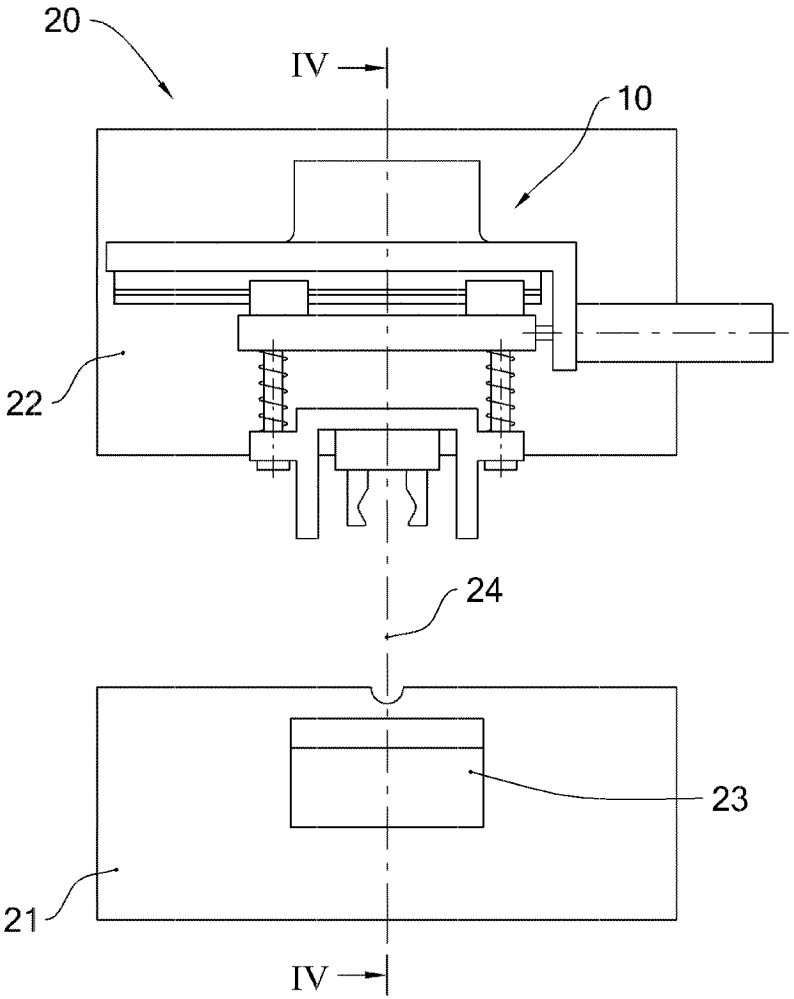
FIG. 3 is a front view of the apparatus of FIG. 1 attached to a forging die.
Figure 4:
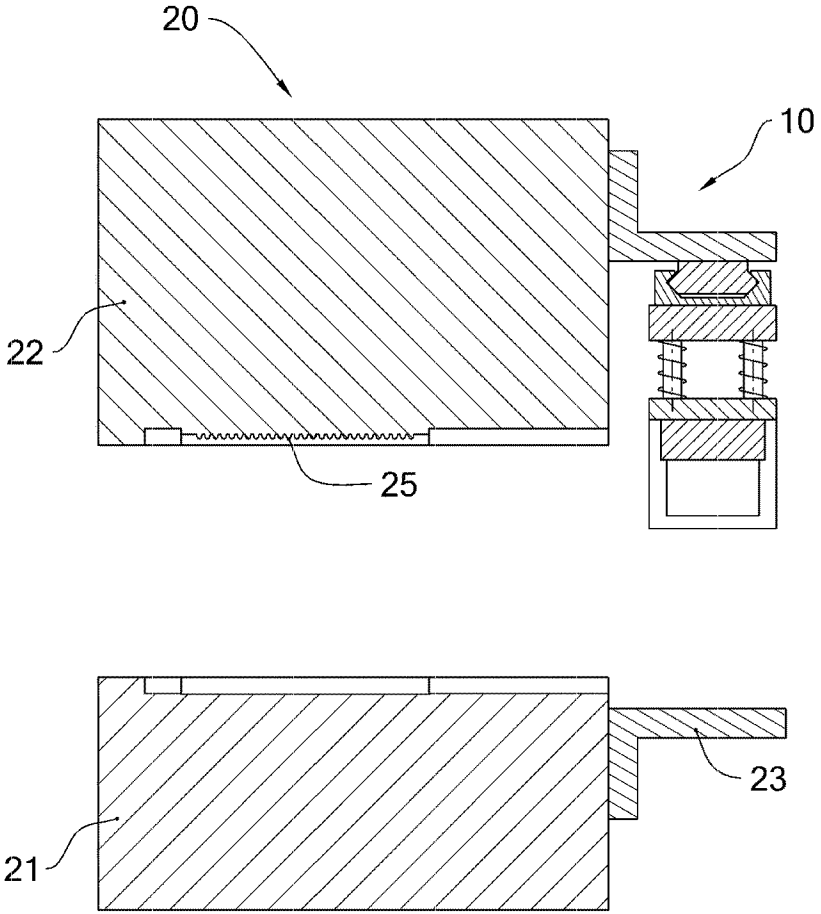
FIG. 4 is a sectional view along IV-IV of the apparatus and die shown in FIG. 3.

FIGS. 1 and 2 depict a first embodiment of an apparatus 10 in accordance with the present invention for supporting a steering rack 1*b* forged in a forging die. FIGS. 3 and 4 show apparatus 10 attached to a forging die 20, and FIGS. 5 to 12 show the sequence to forge a steering rack 1*b* from a bar 1*a* using apparatus 10 and die 20.

Die 20 comprises a lower first die assembly 21 and an upper second die assembly 22. First die assembly 21 has a stop 23 attached to the front of it, which may alternatively be integrally formed into assembly 21. Die 20 is placed in a forging press (not shown) that moves assemblies 21, 22 towards each other along axis 24 to forge rack 1*b* from a bar 1*a* loaded into die 20, axis 24 being the direction of closing of forging die 20. Second die assembly 22 comprises a tooth die 25 having a forming surface shaped as the obverse of the teeth 2 of forged rack 1*b*.

Die 20 is shown in a simplistic form and the detail components and die elements of assemblies 21 and 22 are not shown. Die 20 represents the types of forging dies described in U.S. Pat. No. 4,571,982 (Bishop et al), U.S. Pat. No. 5,862,701 (Bishop et al), WO 2005/053875 A1 (Bishop Innovation), and WO 2011/140580 A1 (Bishop Steering Technology Pty Ltd). These dies are suited to warm forging steering racks.

Apparatus 10 comprises a gripper 11, a lost-motion mechanism 14 and a side-shift mechanism 15. Apparatus 10 is attached to second die assembly 22.

Side-shift mechanism 15 comprises a base bracket 17, a bearing rail 18, bearings 19, a table 30, and an actuator 31. Base bracket 17 is attached to the front of second die assembly 22 (refer to FIGS. 3 and 4). Bearing rail 18 is attached to base bracket 17, and bearings 19 slide along bearing rail 18. Bearings 19 and bearing rail 18 guides the motion of side-shift mechanism 15. Table 30 is supported by bearings 19 such that table 30 can slide sideways with respect to base bracket 17. The direction of the sideways movement is substantially transverse to axis 24 and the axis 3 of forged rack 1*b* when rack 1*b* is being forged by die 20. Preferably bearings 19 comprise re-circulating balls, and bearing rail 18 has a profile to guide the balls.

Actuator 31 drives table 30 back and forth along bearing rail 18. In this embodiment, actuator 31 is a pneumatic cylinder. In other not shown embodiments, the side shift mechanism can utilize means other than bearing rail 18 and bearings 19 to guide its sideways movement and other types of actuator can be used to drive the sideways motion. For example, the actuator may be hydraulic or electro-mechanical, such as a ball screw and servo motor drive.

Lost-motion mechanism 14 comprises a base 16, four guide rods 35 and a coil compression spring 32 on each guide rod 35. Guide rods 35 are attached to and extend from the underside of table 30. Guide rods 35 slide in four corresponding bushes in holes in base 16 such that base 16 is guided to be movable towards and away from table 30 in a direction substantially along axis 24. Springs 32 are positioned between base 16 and table 30 such that they bias base 16 away from table 30. Each guide rod 35 has a head 33 that limits movement of base 16 away from table 30. Base 16 has two legs 34 that are adapted to abut against stop 23 when die 20 closes.

In other not shown embodiments the lost-motion mechanism may comprise guide means other than four rods 35, such as two rods only or any other type of linear bearing means. Also, the lost-motion mechanism may comprise bias means other than coil springs 32, such as pneumatic actuators or other types of spring. The lost-motion mechanism may alternatively be biased towards second die assembly 22 entirely by the weight of base 16 and gripper 11 without any additional bias means.

Gripper 11 is attached to and supported by the base 16 of lost-motion mechanism 14. Gripper 11 is thereby biased towards first die assembly 21 by springs 32 and it is movable along axis 24 relative to second die assembly 22 by guide rods 35. This relative movement is limited by the limited movement of lost-motion mechanism 14.

Gripper 11 comprises a pair of opposed gripper jaws 12 and an actuator 13 to open and close jaws 12. Actuator 13 is preferably pneumatically actuated. However, in other embodiments a hydraulic or electric actuator may be used. In the embodiment shown there is only one gripper 11. In other embodiments the gripper may comprise two or more actuators, each with a pair of gripper jaws. Also, more than one pair of gripper jaws may be attached to a single actuator to space the jaws out along the rack being gripped. Gripper 11 is adapted to grip the shank 5 of steering rack 1*b*.

Figure 5:
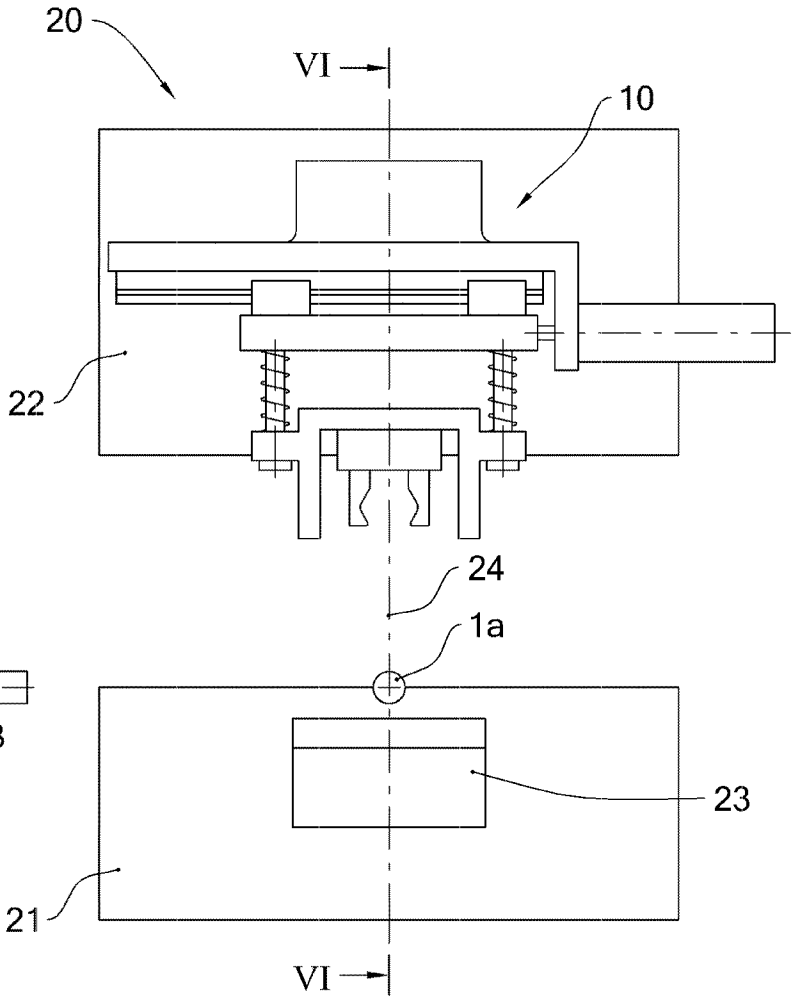
FIG. 5 is a front view of the apparatus and die shown in FIG. 3 with a bar loaded into the die.
Figure 6:
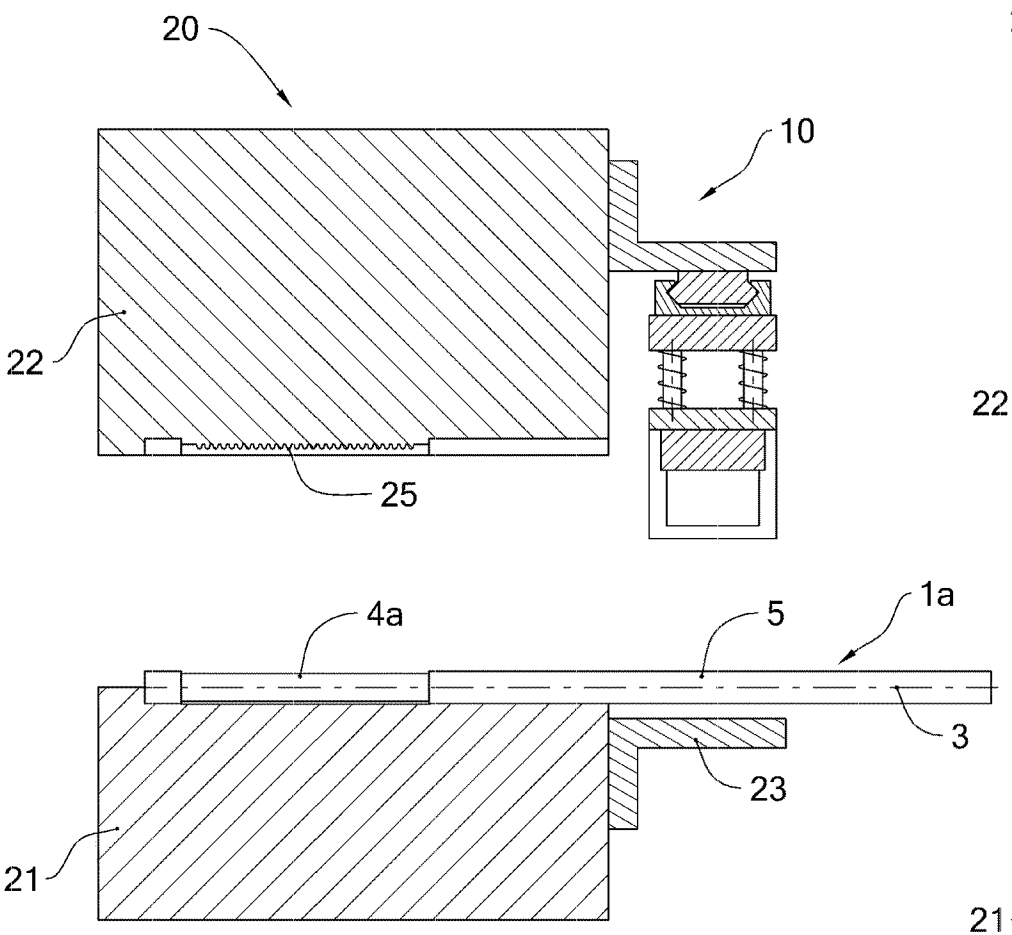
FIG. 6 is a sectional view along VI-VI of the apparatus and die shown in FIG. 5.

The operation of apparatus 10 and die 20 will now be described. Referring to FIGS. 5 and 6, a bar 1*a* is loaded into first lower assembly 21 of die 20. Bar 1*a* comprises a region 4*a* that is heated to a temperature suitable for warm forging (typically between 600° C. and 1000° C.) and a shank 5. Typically bar 1*a* is loaded by a robot gripping shank 5.

Figure 7:
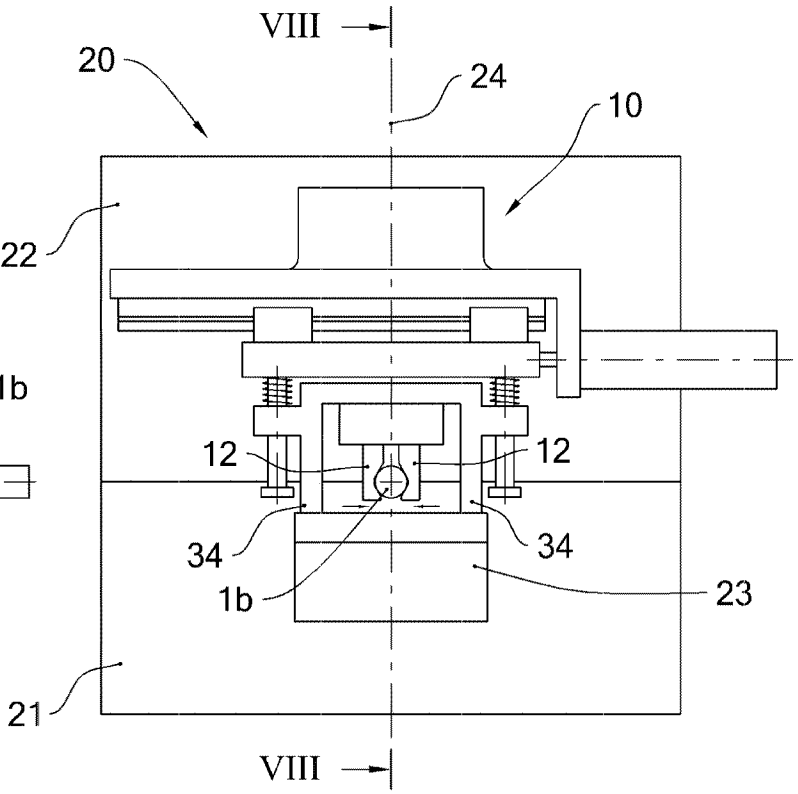
FIG. 7 is a front view of the apparatus and die shown in FIG. 3 with the die closed to forge a rack from the bar.
Figure 8:
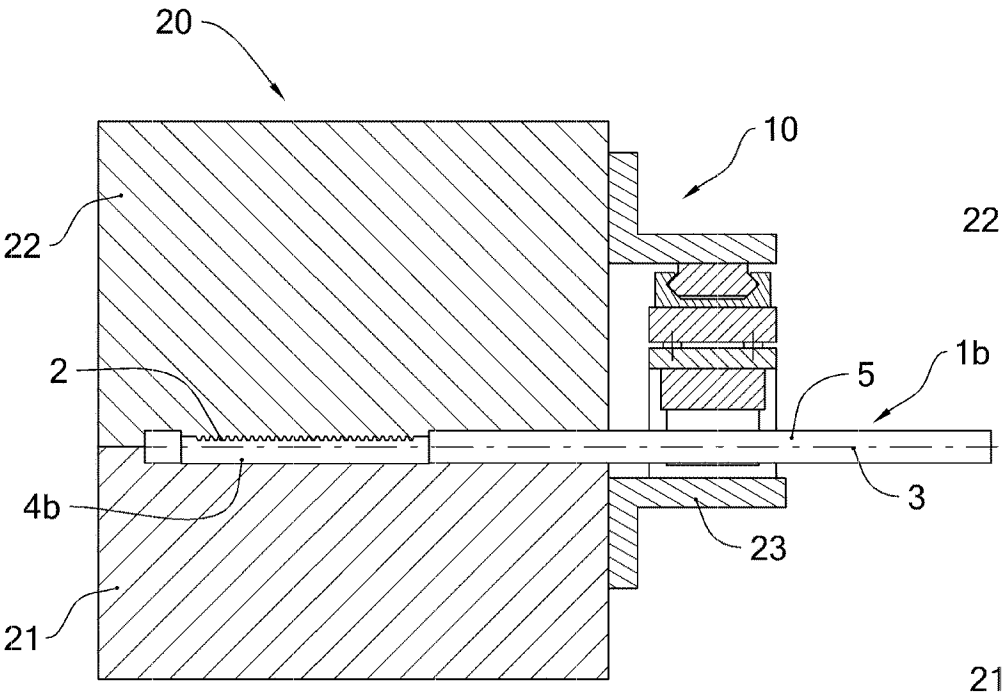
FIG. 8 is a sectional view along VIII-VIII of the apparatus and die shown in FIG. 7.

Referring to FIGS. 7 and 8, Die 20 then closes to forge bar 1*a* into a steering rack 1*b*. The tooth die 25 in second die assembly 22 forges teeth 2 onto a forged region 4*b* of rack 1*b*. As die 20 closes, gripper 11 is open such that jaws 12 pass over and surround the shank 5 of rack 1*b*. As die 20 continues to close, legs 34 of lost-motion mechanism 14 abut stop 23 on first die assembly 21 thereby positioning gripper jaws 12 at a suitable height to grip shank 5 during the final closing travel of die 20. Once lost-motion mechanism 14 abuts stop 23, gripper actuator 13 is operated so that jaws 12 grip the shank 5 of rack 1*b*.

Figure 9:
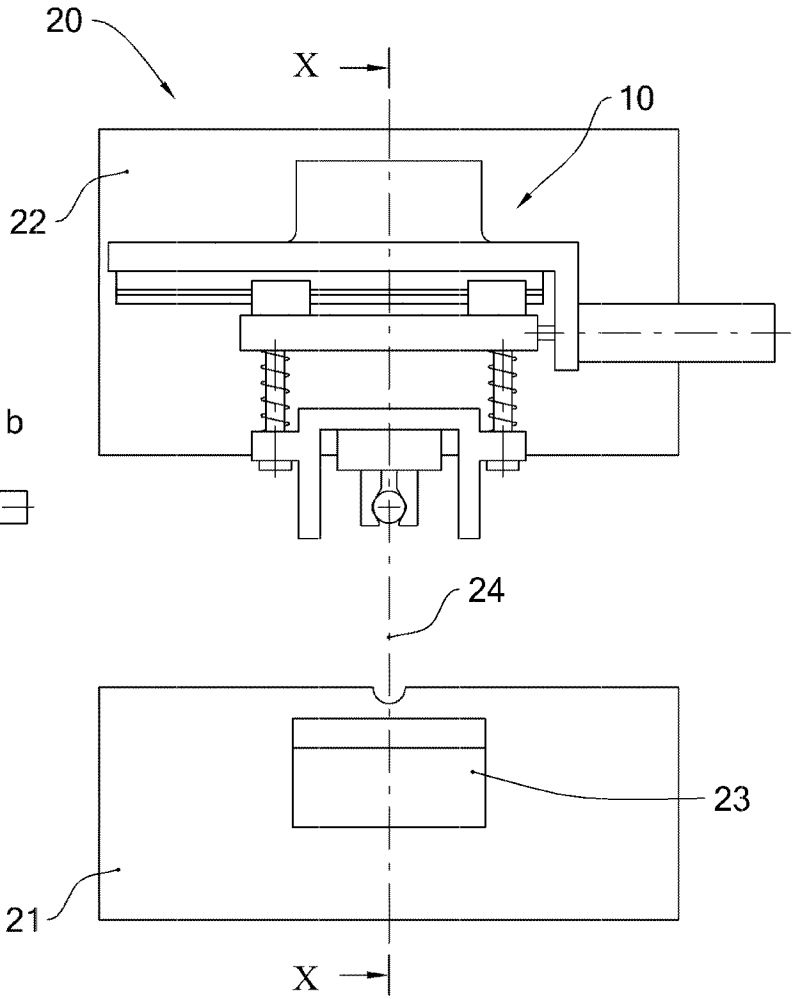
FIG. 9 is a front view of the apparatus and die shown in FIG. 3 with the die opened after forging the rack from the bar.
Figure 10:
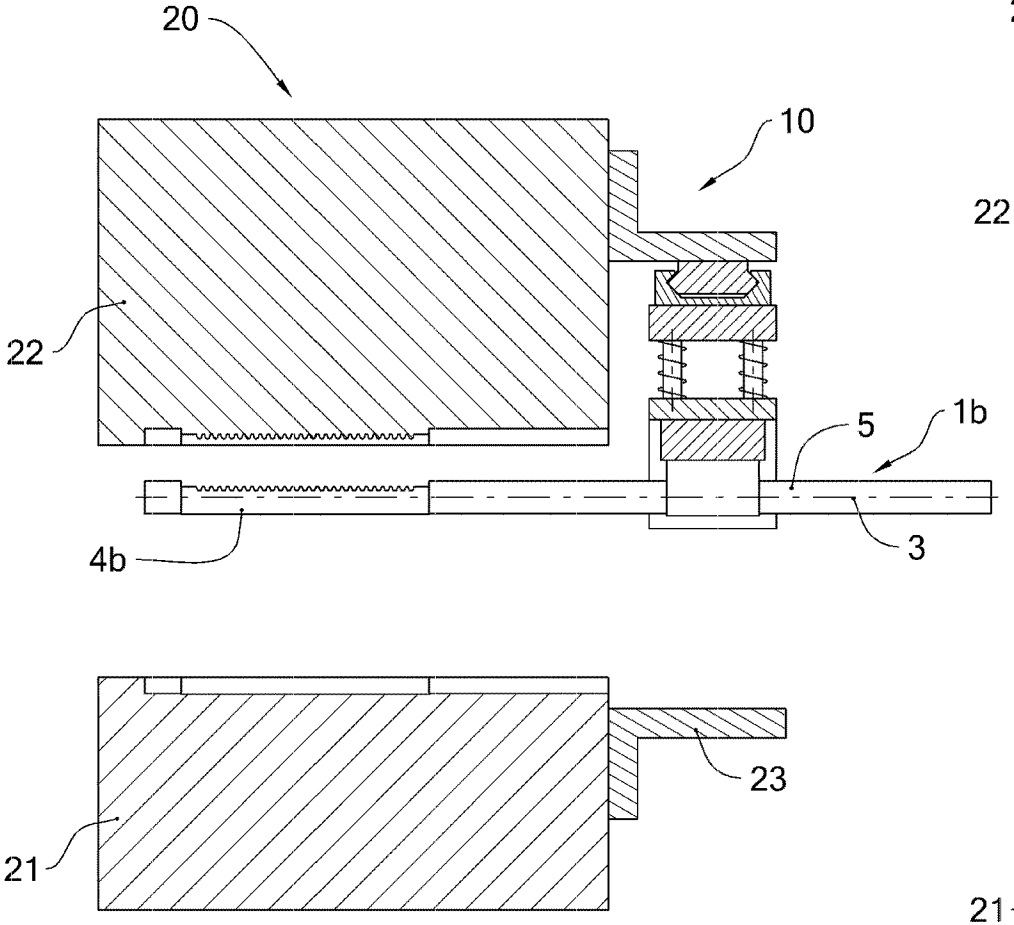
FIG. 10 is a sectional view along X-X of the apparatus and die shown in FIG. 9.

Referring to FIGS. 9 and 10, die 20 then opens. Gripper 11 lifts forged rack 1*b* away from first die assembly 21, and lost-motion mechanism 14 allows gripper 11 to drop with respect to second die assembly 22 thereby providing clearance between forged rack 1*b* and the die elements of second die assembly 22, such as tooth die 25. Forged rack 1*b* is only in contact with the die elements for the minimum possible time because forged rack 1*b* is clear of the die elements as soon as die 20 opens. This minimises heat transfer to the die elements.

Figure 11:
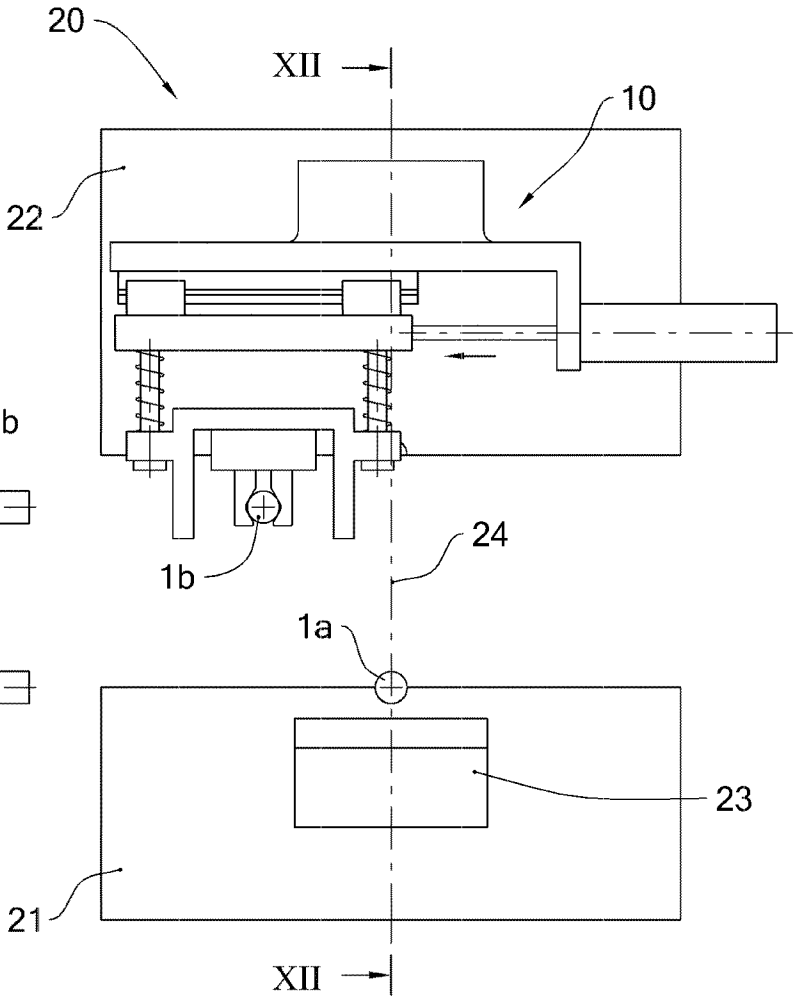
FIG. 11 is a front view of the apparatus and die shown in FIG. 3 with another bar loaded into the die after forging.
Figure 12:
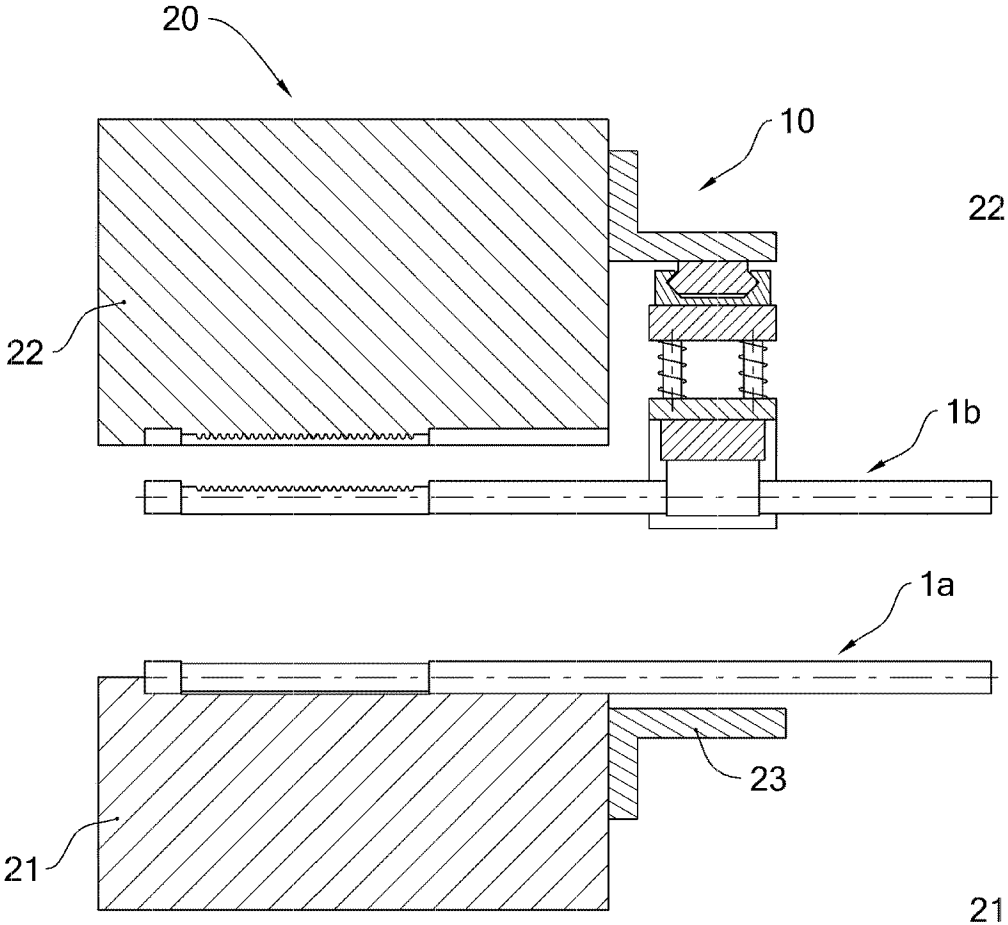
FIG. 12 is a sectional view along XII-XII of the apparatus and die shown in FIG. 11.
Figure 15:
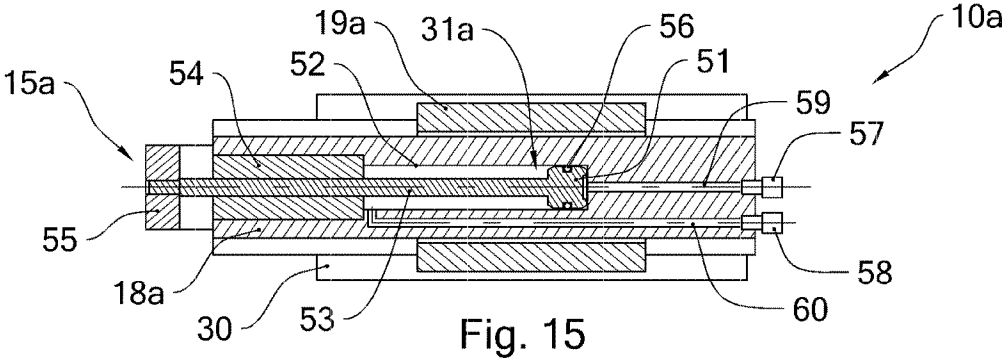
FIG. 15 is a sectional view along XV-XV of the apparatus shown in FIG. 13.
Figure 13:
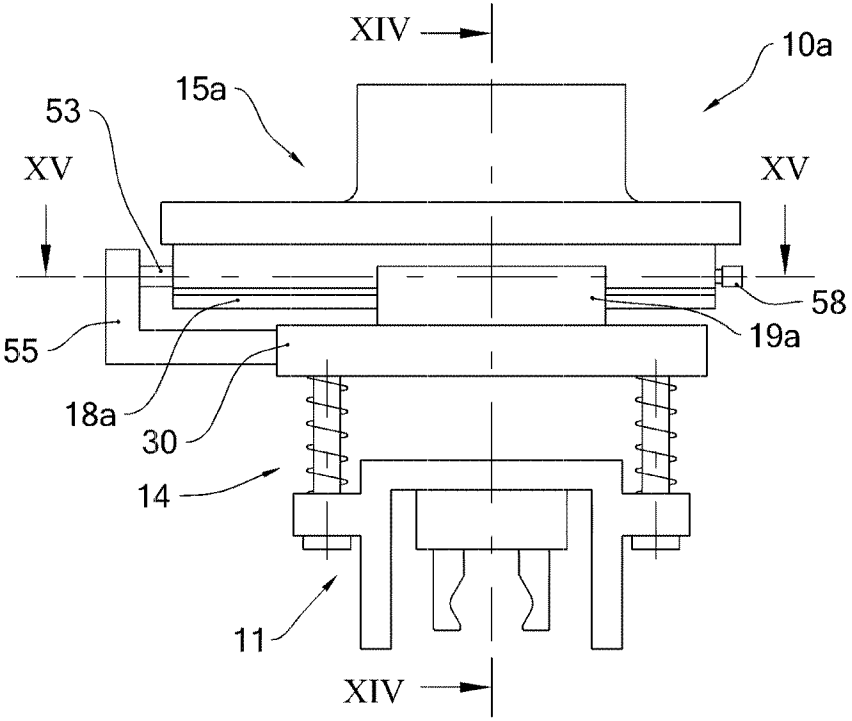
FIG. 13 is a front view of a second embodiment of an apparatus in accordance with the present invention for supporting a forged steering rack after the rack has been forged in a forging die.
Figure 14:
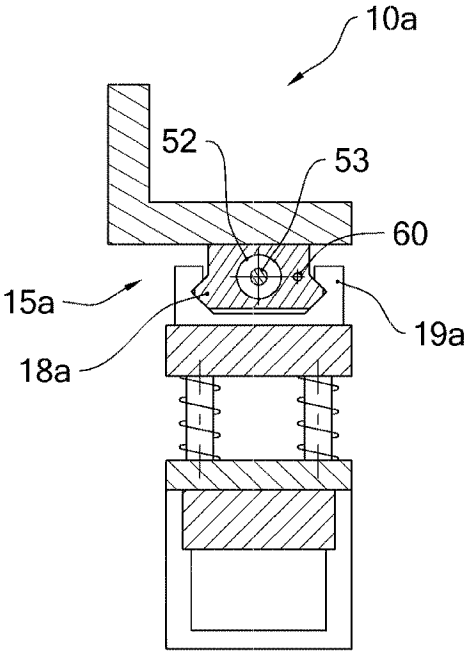
FIG. 14 is a sectional view along XIV-XIV of the apparatus shown in FIG. 13.

Referring to FIGS. 11 and 12, side-shift mechanism 15 then moves gripper 11 and forged rack 1*b* sideways and clear of tooth die 25. Side-shift mechanism 15 can operate once die 20 is fully open or it can commence moving forged rack 1*b* sideways as die 20 opens once forged rack 1*b* is clear of first die assembly 21. Actuator 31 is operated to achieve the side-shift. In this side-shifted position, tooth die 25 and other die elements can be serviced before rack 1*b* is unloaded from apparatus 10, or at the same time as rack 1*b* is being unloaded. Servicing the die typically involves lubricating and/or cleaning it using an automated system that accesses tooth die 25 from the underside of second die assembly 22. Other die elements may also be lubricated. Apparatus 10 thereby reduces the overall cycle time of the die and maximises its productivity because rack 1*b* no longer needs to be unloaded before servicing the die.

Another advantage of apparatus 10 is that the next bar 1*a* can be loaded into die 20 before forged rack 1*b* is removed. If the complete forging cell has 2 robots, then one robot can be loading the die and the other unloading the die. If the cell only has only one robot, then it can unload rack 1*b* from apparatus 10 after loading the next bar 1*a* into die 20. In either case, the cycle time of the die is minimised and its productivity maximised.

Apparatus 10 will typically include several sensors (not shown) to provide feedback to a control system to control the sequence of operation. There may be sensors to detect the limits of travel of the side-shift mechanism 15. There may be sensors to detect the open and closed positions of gripper 10. These sensors may detect the position of the gripper actuator 13 rather than directly detecting the positions of gripper jaws 12. A sensor may also detect the position of lost-motion mechanism 14.

Figure 17:
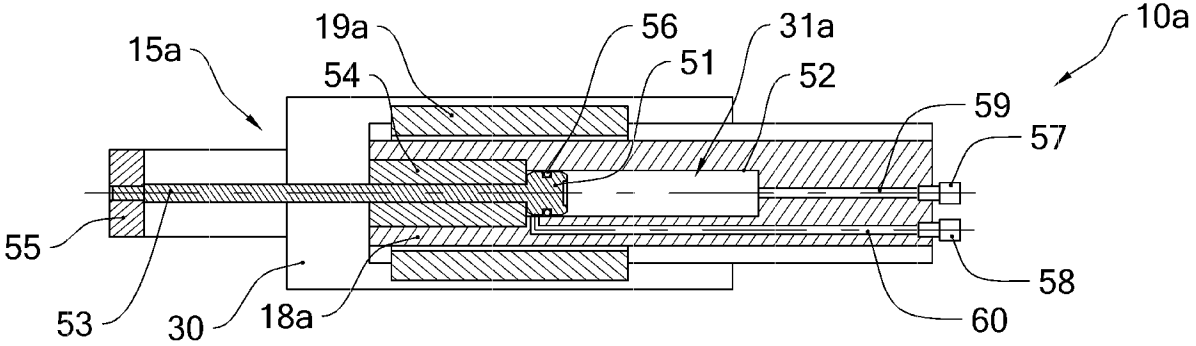
FIG. 17 is a sectional view along XVII-XVII of the apparatus shown in FIG. 16.
Figure 16:
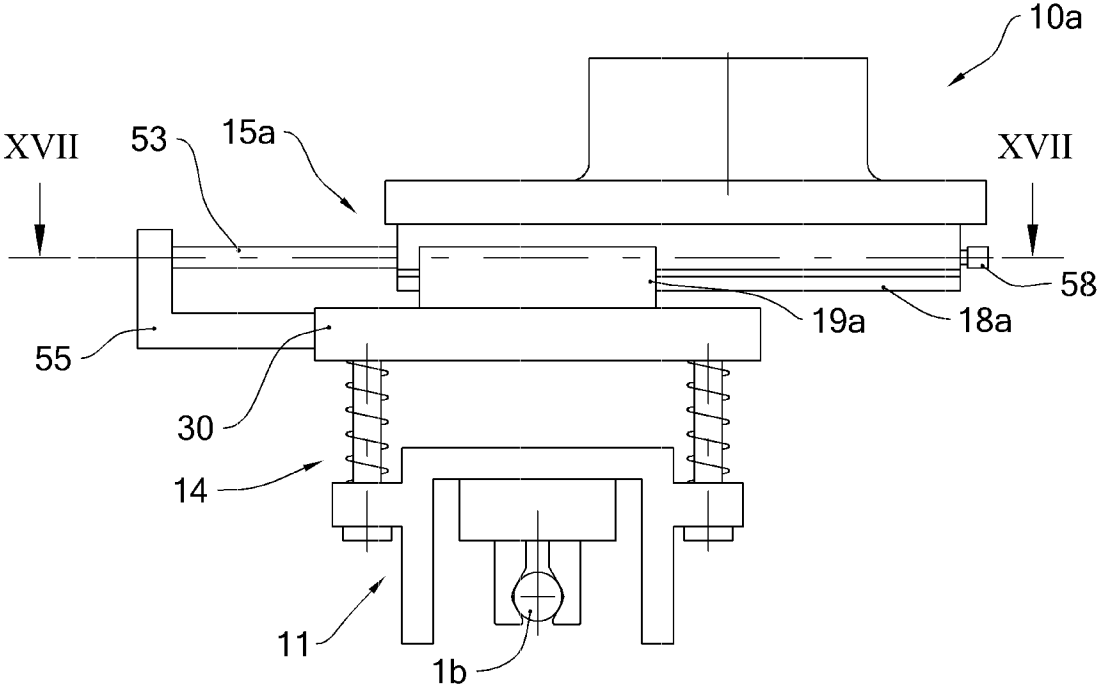
FIG. 16 is a front view of the apparatus shown in FIG. 13 in its side-shifted position.

FIGS. 13 to 17 depict a second embodiment of an apparatus 10*a* in accordance with the present invention. Apparatus 10*a* is the same as and operates in the same manner as apparatus 10 except that its side-shift mechanism 15*a* comprises an alternative to actuator 31. FIGS. 16 and 17 show apparatus 10*a* in its side-shifted position, equivalent to the side-shifted position of apparatus 10 shown in FIG. 11.

The means to actuate side-shift mechanism 15*a* comprises a piston 51 movable within an internal bore 52 in bearing rail 18*a*. Piston 51 is connected to a co-axial rod 53 guided and supported by a bush 54. The end of rod 53 is connected to a bracket 55 that is attached to table 30. Piston 51 has a seal 56. In this embodiment, there is a single long bearing 19*a* instead the two bearings 19 of apparatus 10. The different bearing arrangements can be used with either of the embodiments 10 and 10*a*.

Piston 51 and bore 52 constitute an actuator 31*a* operated by means of pressurised fluid. In this embodiment, the actuation is hydraulic and the fluid is oil. In other not shown embodiments the fluid may be pressurised air (i.e. a pneumatic actuator). Ports 57 and 58 connect externally to a control valve (not shown) that directs the flow of hydraulic oil. Ports 57 and 58 are connected to the control valve by hoses (not shown). Port 57 directs oil to one side of piston 51 through hole 59, and port 58 directs oil to the other side of piston 51 through hole 60. When port 58 is pressurised, side-shift mechanism 15*a* drives table 30 to its right most position shown in FIG. 13, ready for apparatus 10*a* to grip a rack 1*b*. When port 57 is pressurised, side-shift mechanism 15*a* is driven left as shown in FIG. 16 to its side-shifted position. In other not shown embodiments the side-shift may move to the right.

Bearing rail 18*a* will typically be made from a solid length (e.g., single piece) of commercially available bearing rail. Bore 52, holes 59 and 60, and other features are created by machining the solid bearing rail. Bush 54 is screwed or pressed into bearing rail 18*a*.

Apparatus 10*a* is significantly more compact than apparatus 10, which is an advantage in situations where there is limited space to fit the apparatus to a forging die 20. Whilst in the embodiments shown apparatus 10 and 10*a* are attached to the front of second die assembly 22, the apparatus may also be attached in a recess in the front of the die assembly. The die assembly can be relatively large and this allows the apparatus to reach shorter racks 1*b*. In this case the relatively compact arrangement of apparatus 10*a* is an advantage. Gripper jaws 12 may also be offset into the die to access shorter racks 1*b*.

The term "comprising" as used herein is used in the inclusive sense of "including" or "having" and not in the exclusive sense of "consisting only of".

As used herein, when a first object is said to "abut" a second object it means that the first object moves towards the second object until it is blocked from further movement by the second object, either by directly contacting the second object or by contacting a spacer or other relatively rigid member placed between the two objects. Therefore the use of the words "abut" or "abutting" does not necessarily require that the objects directly contact each other.

The invention claimed is:

1. A support apparatus for supporting a steering rack forged in a forging die, the forging die comprising a first die assembly and a second die assembly movable towards each other from an open position to forge the steering rack from a bar loaded into the first die assembly, the support apparatus being separate from the second die assembly and configured to be directly attached to the second die assembly, the support apparatus comprising:

a gripper adapted to grip a shank of the forged steering rack, the gripper being adapted to be open when the forging die is in the open position and the bar is loaded;

a lost-motion mechanism supporting the gripper and configured to permit limited relative movement between the gripper and the second die assembly in the direction of closing of the forging die; and a side-shift mechanism adapted to move the gripper in a sideways direction substantially transverse to an axis of the steering rack and transverse to the direction of closing of the forging die, wherein:

the lost-motion mechanism is adapted to abut the first die assembly as the forging die closes to forge the steering rack from the bar placed in the forging die thereby positioning the gripper to grip the shank of the steering rack during a final closing travel of the forging die, the gripper is operable to grip the shank of the steering rack whilst the lost-motion mechanism abuts the first die assembly, the gripper is adapted to lift the gripped steering rack away from the first die assembly as the forging die opens, and the side-shift mechanism is adapted to move the gripped steering rack in the sideways direction to enable another bar to be placed in the forging die whilst the steering rack is held by the gripper, wherein the lost-motion mechanism is biased towards the first die assembly and includes springs, and wherein the side-shift mechanism includes a bearing rail.

2. The support apparatus as claimed in claim 1, wherein the lost-motion mechanism is biased by the springs.

3. The support apparatus as claimed in claim 1, wherein the lost-motion mechanism is guided by rods, each rod having a head to limit the motion of the lost-motion mechanism.

4. The support apparatus as claimed in claim 1, wherein the second die assembly comprises a tooth die.

5. The support apparatus as claimed in claim 1, wherein the side-shift mechanism is moved by means of an actuator.

6. The support apparatus as claimed in claim 5, wherein the side-shift mechanism further comprises at least one bearing, the at least one bearing being slidable along the bearing rail to guide the motion of the side-shift mechanism, the actuator comprising an internal bore in the bearing rail and a piston movable in the bore.

7. The support apparatus as claimed in claim 6, wherein the actuator is hydraulically actuated.

8. The support apparatus as claimed in claim 6, wherein the bearing rail is formed from a solid length of bearing rail and the bore is machined in the solid length of bearing rail.

9. The support apparatus as claimed in claim 1, wherein the apparatus is adapted to enable the forging die to be serviced whilst the steering rack is held by the gripper.

* * * * *